United States Patent [19]

Matichak

[11] 4,003,109

[45] Jan. 18, 1977

[54] CASKET LINING MEANS

[76] Inventor: William Matichak, 424 Delaware St., Peckville, Pa. 18452

[22] Filed: May 16, 1975

[21] Appl. No.: 578,233

[52] U.S. Cl. ..... 27/19; 24/81 C
[51] Int. Cl.[2] ..... A61G 17/00
[58] Field of Search ..... 27/19, 6, 17; 24/81 C, 24/261 TC, 71.3

[56] References Cited

UNITED STATES PATENTS

| | | | |
|---|---|---|---|
| 1,621,720 | 3/1927 | Harper | 24/261 TC |
| 2,718,687 | 9/1955 | Woltering et al. | 27/19 |
| 3,014,261 | 12/1961 | Nelson | 27/19 |

*Primary Examiner*—John D. Yasko
*Attorney, Agent, or Firm*—Synnestvedt & Lechner

[57] ABSTRACT

Lining construction for a burial casket including an open-topped case defined by side walls having inwardly directed horizontal flanging which terminates in a lip downturned within and extending around the case. A drapery, or skirt-like lining, which may be of single or multi-layer fabric, has an edge portion reversely bent to form a channel within which the lip is received. The channel extends along the lip, and a series of spring wire fasteners are spaced along the lip, each fastener straddling the lip and channel and forcing one side of the channel toward the rear side of the lip, and the other side of the channel toward the forward side thereof, detachably to suspend the lining from the lip. Where several layers of fabric comprise the lining, the lip-mounted channels of preceding layers are received within the channels of subsequent layers, and each layer is secured by a series of fasteners, individual to that layer, spaced with respect to the fasteners of the preceding series, and reacting against the opposite sides of the lip through the side walls of the preceding, nested, channels.

11 Claims, 6 Drawing Figures

Fig. 1.
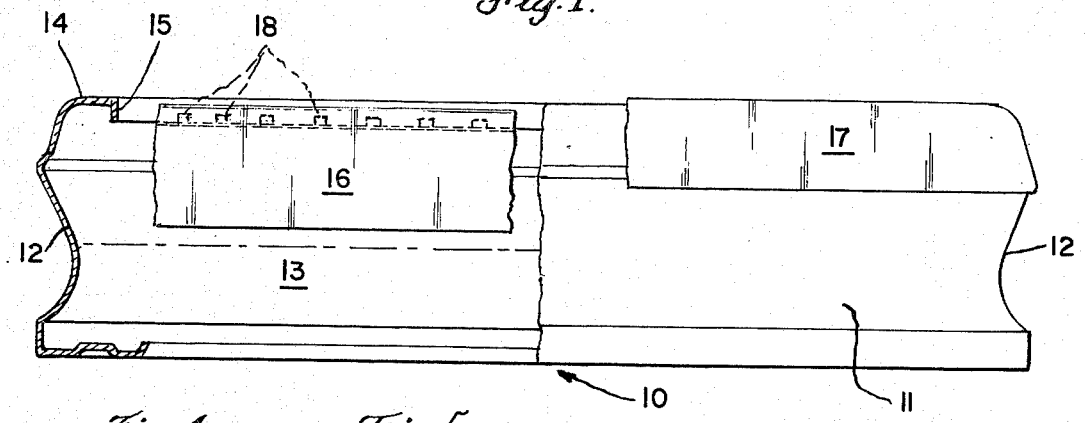
Fig. 4.
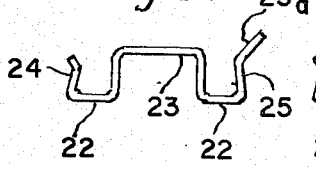
Fig. 5.
Fig. 2.
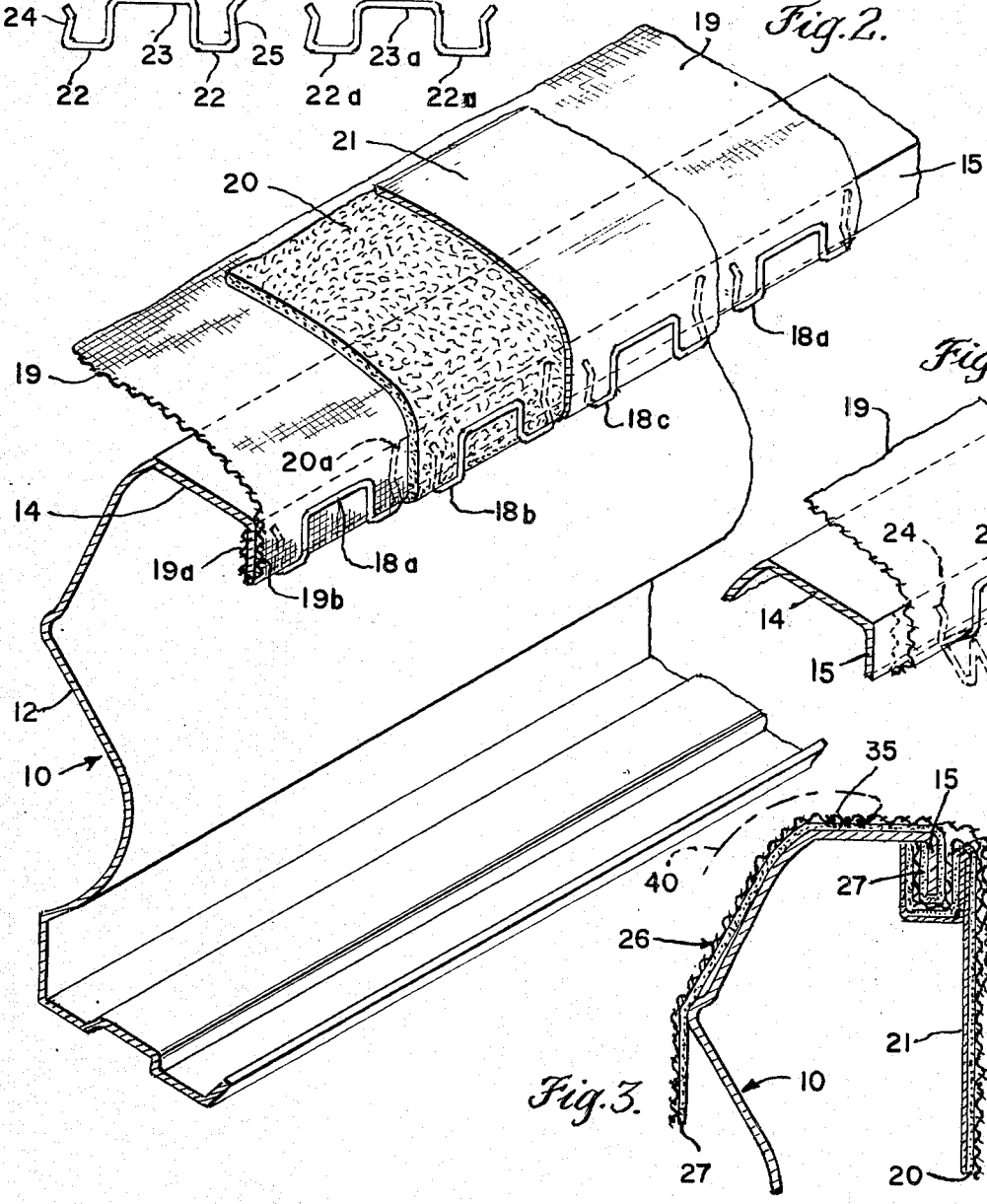
Fig. 6.
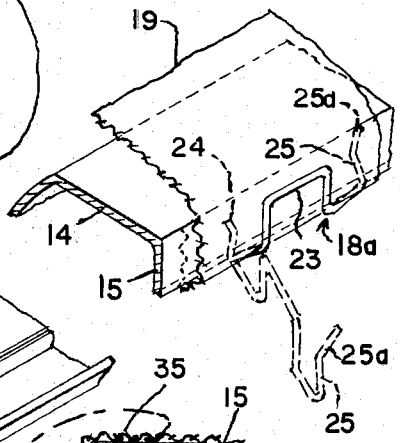
Fig. 3.

CASKET LINING MEANS

BACKGROUND OF THE INVENTION

This invention is concerned with the fastening of cloth finish materials which are commonly secured to the walls of burial caskets. Such finish materials include a skirtlike drapery, or lining, which hangs freely within the casket, being supported from the upper edge portions of the peripheral walls of the case which defines the main casket structure. Frequently such drapery or lining also includes a fabric piece, known as an overthrow, draped across the edge of the case and having lateral edge portions which hang both inside and outside the case prior to sealing of the same.

The lining materials should be readily attachable and detachable to permit selection on the part of the casket purchaser, and this requirement has given rise to a number of problems. Particularly, problems have been encountered because of the requirement for ease of attachment, and due to the fact that skilled labor is usually not available. Attempts to meet the problem by nailing or tacking the lining materials to a wooden frame secured to upper edges of walls of the case, a very common expedient, have not been satisfactory. Even the use of flat spring clips, which have points for piercing the fabric and are sized to be frictionally retained within the downwardly facing channel, formed by the flanging of the casing walls, has not proven entirely satisfactory. Such flat spring clips are difficult to insert and their points tend to tear the material. As a result of these problems, there has continued to exist a demand for better lining mounting means.

SUMMARY OF THE INVENTION

It is the object of my invention to provide improved casing construction having liner mounting apparatus which is very simple to attach and detach, is low in cost, does not require the use of skilled labor, and does not damage the lining materials.

More specifically, the invention has as an object the elimination of wood, nails, straps and the like, by the use of spring fasteners which are readily mounted upon the casing flange, in position in which they straddle the lip thereof and are conveniently accessible. It is a feature of the invention that these fasteners support the materials from both of its faces, since they resiliently urge lining material toward both the inside and the outside surfaces of the lip.

In one aspect of the invention, it is an object to provide a spring fastener for accomplishing the purposes of the invention, and particularly shaped and dimensioned to faciliate finger application of the fasteners to the flanging.

It is a feature of the invention that utilization of the concepts and apparatus thereof make it a simple matter to apply the several layers of a multi-layer lining, layer-by-layer, using a separate series of fasteners for the application of each layer.

In achieving these objectives I provide each layer of material with an edge portion reversely bent to form an elongate channel the sides of which span, extend along, and confront the sides of the lip of the flanging. Each layer has a series of spring wire fasteners, individual to that layer, spaced along the lip, straddling the lip and the side walls of the mentioned channel and forcing the edge of the layer toward the confronting side of the lip, the first layer actually being in contact with said lip.

BRIEF DESCRIPTION OF THE DRAWING

FIG. 1 is a partially sectional and partially elevational view of the casing of a burial casket, and showing my fastening apparatus applied thereto;

FIG. 2 is a fragmentary isometric view illustrating steps in the application of a multi-layer lining, before the materials of said lining have been lowered within the case;

FIG. 3 is a fragmentary sectional view of an embodiment which includes, in addition to the materials hanging within the case, an overthrow, a padded portion of which has a channel secured to the casket lip, and lateral portions of which are draped across the upper edge of the casket to hang both on the inside and the outside thereof;

FIGS. 4 and 5 are detailed views of resilient fasteners which may be used in practicing the invention; and FIG. 6 is a fragmentary, isometric, view illustrating the way in which a fastener is applied to the flange.

DETAILED DESCRIPTION OF THE INVENTION

For exemplary purposes, the invention is described with reference to a multi-layer lining sheet. It will be understood that, under some circumstances, the sheet may comprise a single layer and that, whether single or multi-layer, the lining may be used in conjunction with an overthrow. The overthrow is applied to the casket in the same manner as the lining layers, and for the purposes of this invention may be considered a part of the lining.

With initial reference to FIGS. 1 and 2, there is illustrated a burial casket comprising a casing 10 having side, front and rear walls, 11, 12 and 13, respectively, and which walls have a horizontal, inwardly directed, flange 14 which terminates in a lip 15 which depends within the case, and extends around at least a substantial part of the periphery thereof. A skirt-like lining, shown at 16 in FIG. 1, hangs from the lip 15 downwardly toward the floor portion of the casket. Generally couch material, not illustrated, overlies the floor and extends up to substantially the elevation of the lower edge of the lining 16. As is clear from the right hand, elevational, portion of FIG. 1, an overthrow 17 may also be used, hanging across the upper edges of the forward portion of the case 10 and being secured in a manner described below. In particular accordance with the present invention, resilient fasteners 18 are spaced along the edge of lip 15 to secure the lining 16 thereto.

As appears to best advantage in FIG. 2, the individual layers of the multi-layer lining are applied to the casket sequentially and each has a series of fasteners, individual thereto, which are supported upon the lip 15. As illustrated in FIG. 2, in a multi-layer embodiment the first layer of material to be applied may comprise a sheet 19 of silk or rayon crepe, the second layer is of cotton padding material 20 of any convenient type, and a third layer may conveniently comprise a paper backed plastic backing sheet 21. Whatever materials are used, the several layers are applied sequentially to the lip 15 and each layer is held by its own series of resilient fasteners. In FIG. 2, two fasteners **18*a*, of the first series, are shown as securing the sheet 19 to the flange lip 15, one fastener 18*b*, of the second series, is shown as securing the padding material 20, and fasteners 18*c* secure the third or backing sheet 21**.

As will now be understood, each layer is reversely bent to form a channel which has side portions which lie along the opposite sides of the lip 15. For example, the sheet 19, which in the embodiment shown in FIG. 2 is the first layer to be applied and is that which is visible as a lining hanging within the case, has channel sides 19*a* and 19*b*, the first of which confronts and extends along the rear side of the lip 15 and the second of which confronts and extends along the forward side of the lip. Since this sheet is the first applied, it's channel sides are in direct contact with the sides of the lip. The channel sides of subsequent layers, of course, bear against the lip through the intermediation of the channel sides of preceding layers.

As stated, each layer is held by its own series of fasteners which are applied along the lip, in spaced relationship, the mode of application being illustrated in FIG. 6. Preferably, although not necessarily, the fasteners, of which two types are illustrated in FIGS. 4 and 5, are of triple U configuration. Desirably, they are fabricated of spring wire of a grade known as "music" wire. Fasteners which have proven highly successful in use have measured about 1½ inches in overall, point-to-point, length, with a lateral (height) dimension of about ⅜ inch. Stock from which the fasteners are made preferably has a cross section from about 0.038 inch to 0.041 inch. Either "bright basic" or "phosphate" finishes have proven to be satisfactory. With fasteners of these dimensions, it is convenient to utilize a flange lip having a height of about ½ inch.

Referring to FIGS. 4 and 5, it will be seen that each fastener comprises a pair of outboard U-shaped portions which are open in one direction and which appear, in the embodiment of FIG. 4, at 22,22, while a center U, which faces in the opposite direction, is shown at 23. Similar parts of the fastener of FIG. 5 are shown at 22*a*, 22*a*, and at 23*a*. The fasteners are applied in the manner shown in FIG. 6, by forcing them into position in which they straddle the lip 15, and bear against the channel sides of the layer being mounted. The sheet 19 is shown in FIG. 6, and a lefthand free end part of the fastener, which appears at 24, is placed behind the lip in contact with channel side 19*a*. Swinging the fastener, from the position shown in phantom lines in FIG. 6, to its full line position, and forcing the right hand free leg portion 25 behind the lip completes the mounting of a fastener. When mounted, as is apparent without further description, the center U lies to the outside of the lip.

While fasteners of various kinds are contemplated by the broader aspect of this invention, a fastener of the kind shown in FIG. 4 is preferred. In such a fastener, as shown at 25*a*, one leg terminates in an upwardly and outwardly directed end which is longer than the corresponding end at the opposite side of the fastener. It is this longer end 25*a* which is grasped by the fingers, and its greater extension facilitates flexing of the right hand leg 25 and insertion of the same behind the lip. This simple improvement has been found to ease finger tension substantially, and facilitate mounting of the fasteners.

With the first sheet 19 lying backwardly across the flange 14, its series of fasteners 18*a* being in place, the second sheet 20 is reversely bent to provide its channel-shaped edge 20*a*. The channel sides 19*a*, 19*b* are nested within the channel 20*a* of the second sheet. At this point in the assembly, and as is clear from FIG. 2, the second series of fasteners is applied to hold the second layer comprising padding material 20, one such fastener being shown at 18*b*. The bending to form a channel and the securement of the third layer comprising backing sheet 21, utilizing the fasteners 18*c*, will be understood without further description. After all three layers which comprise the composite lining have been applied, in the manner described above, the three layers of lining material are swung downwardly within the case and hang in the position shown at 16 in FIG. 1.

FIG. 3 illustrates in section the manner in which an overthrow 26 may be used as a part of, or in conjunction with, the interior lining. It will be understood that the sheet thicknesses are exaggerated in FIG. 3, to show the various channel folds. However, when the clips have all been applied, the material actually forms a relatively thin joint around the lip 15.

Preferably, the overthrow 26 has an underlying padded portion 27 and a rayon or silk sheet 27*a* overlying the padded portion 27 and stitched thereto, as shown at 35. The overthrow 26 is the first layer applied and one end of the padded portion 27 is reversely bent and occupies the position immediately adjacent and in contact with the lip 15. As shown, the other end of the padded portion 27 extends downwardly across a forward wall of the case. During application of the overthrow 26, and securement of padded portion 27 to the lip, utilizing fasteners of the kind described above, the unstitched end of overlying sheet 27*a* is first folded back, as appears in dotted lines at 40 in FIG. 3, thus permitting mounting and securement of the other three layers 19, 20 and 21 which comprise the interior lining. After assembly of said other layers, sheet 27*a* is lowered into positon (full lines in FIG. 3) in which it hides the region of securement of the various layers to the lip 15. As noted above, the various channel folds of the several layer are shown in section, on an enlarged scale, in FIG. 3. However, to avoid obscuring the channel folds, and with the exception of the folded end of padded portion 27 of overthrow 26, reference numerals have not been applied to the channel folds of the lining materials as shown in FIG. 3.

The term "lining", as used in the accompanying claims should be understood as contemplating not only the usual hanging skirt (in this case made up of three layers), but also the overthrow, the overlying portion of which hangs within the casket. Also, it will be appreciated that the term lining, as used in the claims and unless otherwise stated, contemplates single layer of material as well as a plurality of layers of material. In the preferred form in which the lining comprises a plurality of layers of material, each of the layers is secured to the lip of the flanging of the casket as described above. However, it should be understood that the present invention can be used in connection with embodiments in which at least one, but less than all, of the plurality of layers of material is secured to the case of the casket by other means.

I claim:

1. In a casket structure; a case including a side wall defining a portion of the case, an upper edge portion of said side wall having an inwardly directed, generally horizontal flanging which terminates in a lip which depends within the case and has a forward side facing away from said wall; a lining secured to said lip and having an edge portion folded to form an elongate lining channel, one side of which extends along and faces one side of said lip, and the other side of which extends along and faces the opposite side of said lip; and detachable means securing said lining channel to said lip, said means comprising a plurality of resilient fasteners spaced along said lip, each fastener having portions straddling said lip and in engagement with the two sides of said lining channel and forcing each of the sides of said channel toward the side of the lip which it faces, whereby to support said lining from said lip.

2. Casket structure in accordance with claim 1, and further characterized in that said fasteners are fabricated of spring wire.

3. Casket structure in accordance with claim 2, wherein said spring wire fastener has at least one zone of generally U-shaped which is engaged with that side of said channel which faces the forward side of said lip, and a pair of arms which extend from said zone and are engaged with that side of said channel which faces the opposite side of said lip.

4. Casket structure in accordance with claim 1 wherein said lining channel is in contact with said lip.

5. Casket structure according to claim 1 and in which said lining comprises three layers of material, one edge portion of each of said layers folded to form said lining channel, the channels being in nested relation with the walls of the innermost channel being in contact with said lip, and each layer being secured to said lip by a series of said fasteners individual to that layer and straddling and securing the channels as defined.

6. Casket structure in accordance with claim 1 wherein said lining comprises at least 2 layers of material including a first layer in contact with said lip and the other of said layers overlying said first layer, one edge portion of each of said layers being folded to form said elongate lining channel, the lining channel of said first layer being secured to said lip by a first series of said fasteners and the lining channel of the other of said layers being secured to said lip by another series of said fasteners.

7. Casket structure according to claim 6 including 3 layers of material, said first layer comprising a decorative material, a second layer in contact with and overlying said first layer and comprising padding material, and a third layer in contact with and overlying said second layer and comprising backing material.

8. Casket structure according to claim 6 wherein said first layer comprises an overthrow having portions adapted to hang both outside and inside of said case.

9. In a casket structure: an open-topped case including side walls extending about and defining the case, upper edge portions of said side walls having inwardly directed generally horizontal flanging which terminates in a lip which depends within the case and extends around at least a substantial part of the periphery thereof; a lining extending from said lip downwardly within said case and having an edge portion folded to form an elongate lining channel, one side of which extends along and faces one side of said lip, and the other side of which extends along and faces the opposite side of said lip; and detachable means securing said lining channel to said lip, said means comprising a plurality of resilient wire fasteners, each of substantially triple-U shape and cooperating to secure said lining to said lip, each fastener having a pair of outboard U's, open in one direction, and an oppositely facing U intermediate said pair, individual fasteners being disposed in a series spaced along said lip with portions of each straddling the lip in such manner that wire portions defining said intermediate U are engaged with and forceably urge said one side of said lining channel toward said one side of said lip, and wire portions defining said outboard U's engaged with and forceably urging said other side of said lining channel toward said opposite side of said lip.

10. Casket structure according to claim 9 and in which said lining comprises at least two layer of material, edge portions of each folded to form said lining channel, the channel of one layer being nested within the channel of the other layer and being secured to said lip by a first series of said fasteners, and the channel of another layer overlying and being in contact with the channel of the first layer and secured thereagainst by a second series of said fasteners spaced along said lip with respect to the fasteners of said first series, and reacting against the lip through the side walls of the nested channels.

11. A clip-like spring wire fastener for use in securing lining material to the lip of flanging of a burial casket, said fastener being of substantially triple-U shape and including a pair of outboard U's, open in one direction, and an oppositely facing U intermediate said pair, each outboard U terminating in free-end portions curved outwardly from the center of the fastener, one of said free end portions being substantially longer than the other thereof, and facilitating finger engagement with the fastener and resilient flexing of the same during mounting of the fastener to said lip.

* * * * *